US008471777B2

(12) United States Patent
Lin et al.

(10) Patent No.: US 8,471,777 B2
(45) Date of Patent: Jun. 25, 2013

(54) ANTENNA APPARATUS

(75) Inventors: Junn Yi Lin, Hsinchu County (TW); Xin Chang Chen, Hsinchu County (TW)

(73) Assignee: Ralink Technology Corporation, Jhubei, Hsinchu County (TW)

( * ) Notice: Subject to any disclaimer, the term of this patent is extended or adjusted under 35 U.S.C. 154(b) by 310 days.

(21) Appl. No.: 12/906,400

(22) Filed: Oct. 18, 2010

(65) Prior Publication Data

US 2011/0102288 A1 May 5, 2011

(30) Foreign Application Priority Data

Nov. 2, 2009 (TW) ..... 98137065 A

(51) Int. Cl.
*H01Q 1/52* (2006.01)
*H01Q 1/24* (2006.01)

(52) U.S. Cl.
USPC ..... 343/841; 343/702

(58) Field of Classification Search
USPC ..... 343/702, 700 MS, 841, 795
See application file for complete search history.

(56) References Cited

U.S. PATENT DOCUMENTS 5,517,676 A * 5/1996 Sekine et al. ..... 455/575.5
7,398,113 B2 * 7/2008 Kozakai et al. ..... 455/575.7

FOREIGN PATENT DOCUMENTS

EP 0548975 6/1993
EP 1445825 8/2004

* cited by examiner

*Primary Examiner* — Hoanganh Le
(74) *Attorney, Agent, or Firm* — Hamre, Schumann, Mueller & Larson, P.C.

(57) ABSTRACT

An antenna apparatus comprises a planar monopole antenna device and an extending layer. The planar monopole antenna device includes an electromagnetic shielding box. The extending layer is composed of electric conducting material and extends outward from a feed point of the electromagnetic shielding box.

20 Claims, 5 Drawing Sheets

ANTENNA APPARATUS

BACKGROUND OF THE INVENTION

1. Field of the Invention

The present invention relates to an antenna apparatus, and more particularly, to an antenna apparatus including an electromagnetic shielding box.

2. Description of the Related Art

In a wireless communication system, an antenna apparatus is needed to transmit and receive electromagnetic wave carrying signals. Dipole antenna architecture is one of the basic antenna architectures and originated from an invention in the $19^{th}$ century. FIG. 1 shows the architecture of a dipole antenna. As shown in FIG. 1, the dipole antenna 100 comprises two antenna ends extending outward from a feed point. A first antenna end 104 serves as a signal source of the dipole antenna 100. A second antenna end 106 serves as a ground of the dipole antenna 100. The current directions of the first antenna end 104 and the second antenna end 106 are shown in FIG. 1, wherein the current level reaches the highest level at the feed point, and reaches zero at the ends of the first antenna end 104 and the second antenna end 106. There are many examples of the application of the dipole antenna. One example is the early TV antenna design.

The following introduces the architecture of monopole antenna, another basic antenna architecture, which is derived from the dipole antenna architecture. FIG. 2 shows the architecture of a monopole antenna. The monopole antenna 200 comprises one antenna end 204 extending outward from a feed point. The antenna end 204 is perpendicular to a ground plane. As shown in FIG. 2, the ground plane replaces the second antenna end 106 of the dipole antenna 100. Accordingly, the antenna end 204 serves as a signal source of the monopole antenna 200, and the ground plane serves as the ground of the monopole antenna 200. The current directions of the antenna end 204 and the ground plane are shown in FIG. 2, wherein the current of the ground plane is scattered from the feed point to the vicinity thereof. Examples of the application of monopole antennas include radio masts and towers.

For small wireless communication apparatuses, such as a wireless communication apparatus in a universal serial bus (USB) application, both dipole antenna and monopole antenna designs may serve as the antenna apparatus of the wireless communication apparatus. FIG. 3 shows a side view of a conventional monopole antenna in a USB application. As shown in FIG. 3, the monopole antenna 300 comprises a printed circuit board 302, an antenna end 304 and an electromagnetic shielding box 306. The printed circuit board 302 comprises a radio frequency circuit of the monopole antenna 300. The antenna end 304 comprises a metal antenna and is connected to the printed circuit board 302. The electromagnetic shielding box 306 covers the printed circuit board 302 to provide noise suppression for the monopole antenna 300.

FIG. 4 shows a schematic view of the monopole antenna 300 shown in FIG. 3. As shown in FIG. 4, the antenna end 304 serves as a signal source of the monopole antenna 300, and the electromagnetic shielding box 306 serves as a ground of the monopole antenna 300.

Conventional monopole antennas in a USB application inherit disadvantages of typical monopole antennas. For example, compared to dipole antennas, monopole antennas exhibit lower input impedance. In addition, dipole antennas have higher radiation resistance than monopole antennas, and accordingly are more efficient than monopole antennas. On the other hand, small wireless communication apparatuses using dipole antennas may not meet consumer requirements since dipole antennas require much greater size.

Therefore, there is a need for an antenna apparatus that exhibits both small size and high efficiency, combining advantages of monopole and dipole antenna designs. The present invention provides such antenna apparatus.

SUMMARY OF THE INVENTION

The present invention discloses an antenna apparatus, which uses an extending layer such that the antenna apparatus exhibits characteristics of a dipole antenna. Accordingly, the efficiency of the antenna apparatus is improved.

The antenna apparatus according to one embodiment of the present invention comprises a planar monopole antenna device and an extending layer. The planar monopole antenna device includes an electromagnetic shielding box. The extending layer is composed of electrical conducting material and extends outward from a feed point of the electromagnetic shielding box.

The antenna apparatus according to another embodiment of the present invention comprises a printed circuit board, an antenna end, an electromagnetic shielding box and an extending layer. The printed circuit board comprises a radio frequency circuit. The antenna end is connected to the printed circuit board. The electromagnetic shielding box covers the printed circuit board. The extending layer is composed of electrical conducting material and extends outward from a feed point of the electromagnetic shielding box.

BRIEF DESCRIPTION OF THE DRAWINGS

The objectives and advantages of the present invention will become apparent upon reading the following description and upon referring to the accompanying drawings of which.

DETAILED DESCRIPTION OF THE INVENTION

Figure 1:
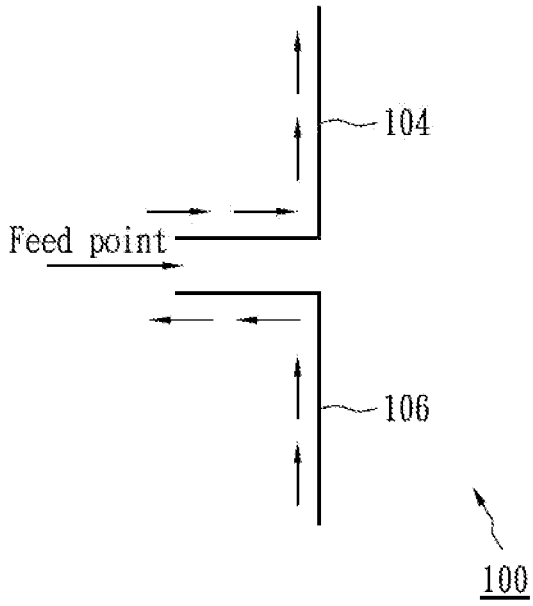
FIG. 1 (Prior Art)
FIG. 1 shows an architecture of a dipole antenna.
Figure 2:
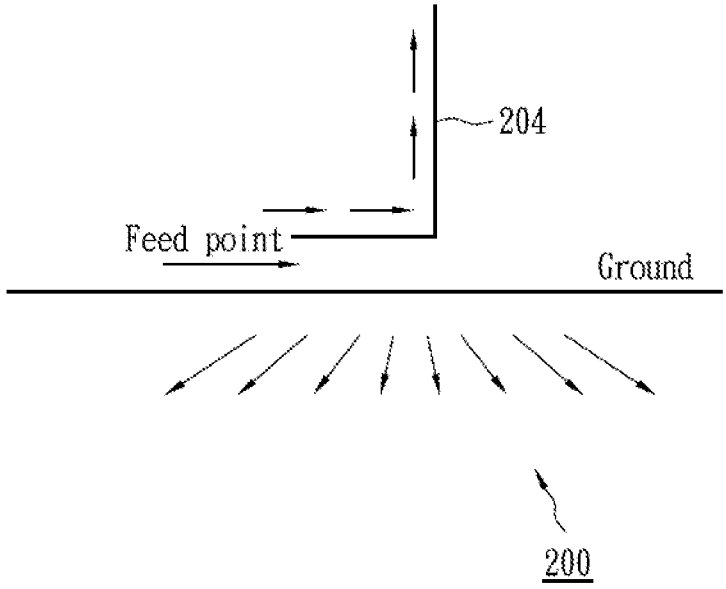
FIG. 2 (Prior Art)
FIG. 2 shows an architecture of a monopole antenna.
Figure 3:
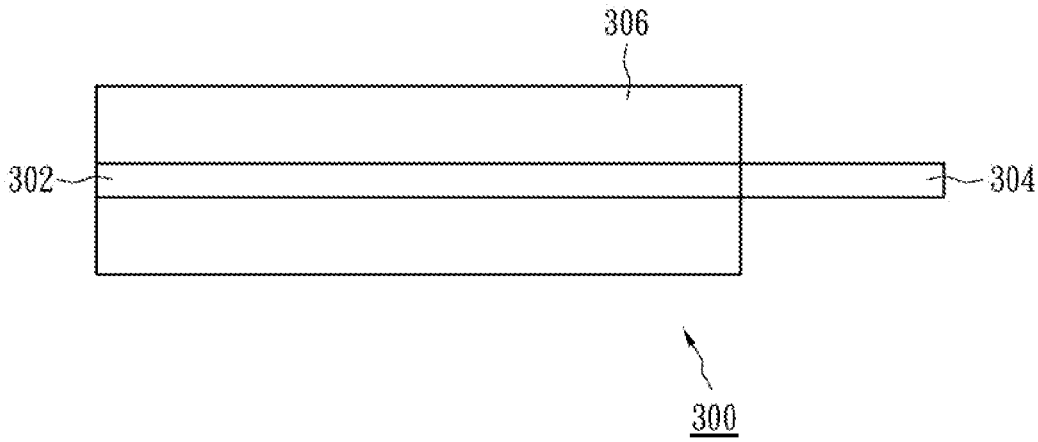
FIG. 3 (Prior Art)
FIG. 3 shows a side view of a conventional monopole antenna.
Figure 4:
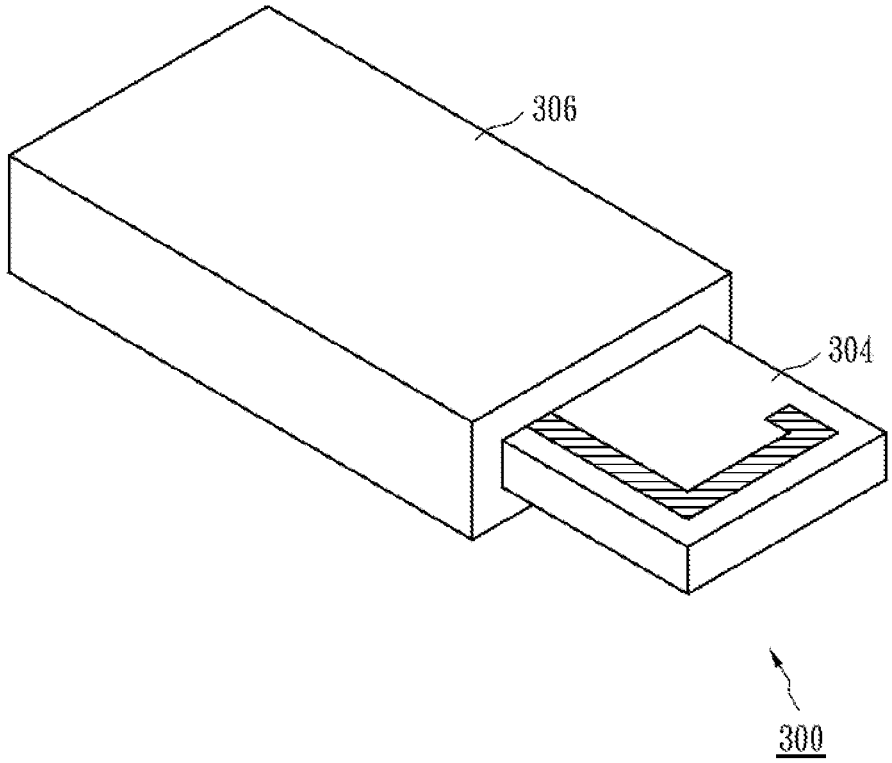
FIG. 4 (Prior Art)
FIG. 4 shows a schematic view of a conventional monopole antenna.
Figure 5:
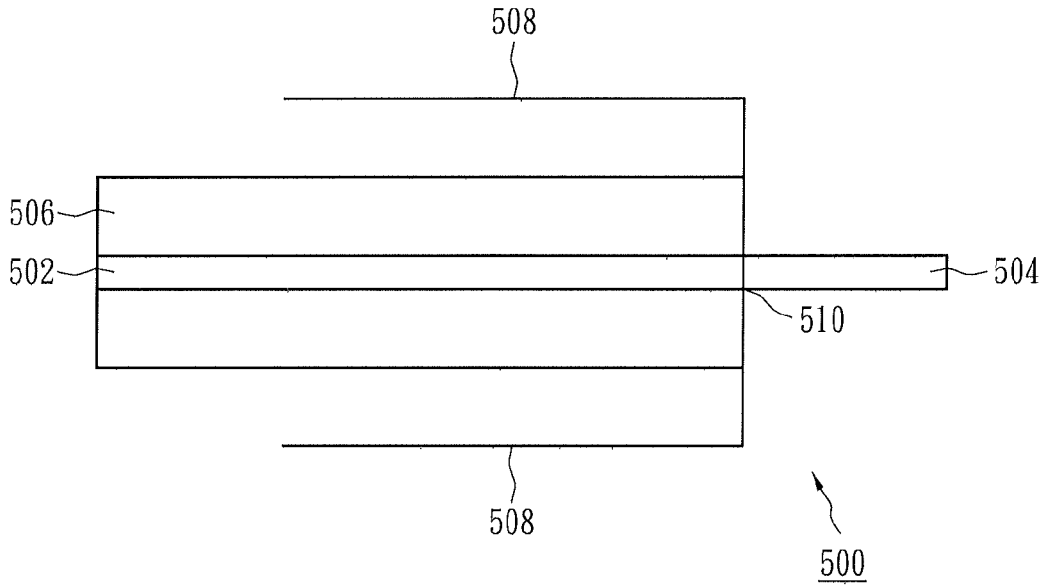
FIG. 5 shows a side view of an antenna apparatus according to one embodiment of the present invention.

FIG. 5 shows a side view of an antenna apparatus according to one embodiment of the present invention. As shown in FIG. 5, the antenna apparatus 500 comprises a printed circuit board 502, an antenna end 504, an electromagnetic shielding box 506 and an extending layer 508. The printed circuit board 502 comprises a radio frequency circuit of the antenna apparatus 500. The antenna end 504 comprises a bent metal antenna, and is connected to the printed circuit board 502. The electromagnetic shielding box 506 covers the printed circuit board 502 to provide noise suppression for the antenna apparatus 500. The extending layer 508 is composed of electrical conducting material, and extends outward from a feed point 510 of the electromagnetic shielding box 506.

The architecture of the combination of the printed circuit board 502, the antenna end 504 and the electromagnetic shielding box 506 is similar to that of a monopole antenna. In other words, the antenna end 504 serves as a signal source of the antenna apparatus 500. However, the extending layer 508 extending from the feed point 510 of the electromagnetic shielding box 506 serves as a ground of the antenna apparatus 500. That is, the antenna apparatus 500 comprises an antenna end 504 serving as a signal source and an extending layer 508 serving as a ground. Therefore, the antenna apparatus 500 acts as a dipole antenna, and thus it exhibits higher efficiency.

Figure 6:
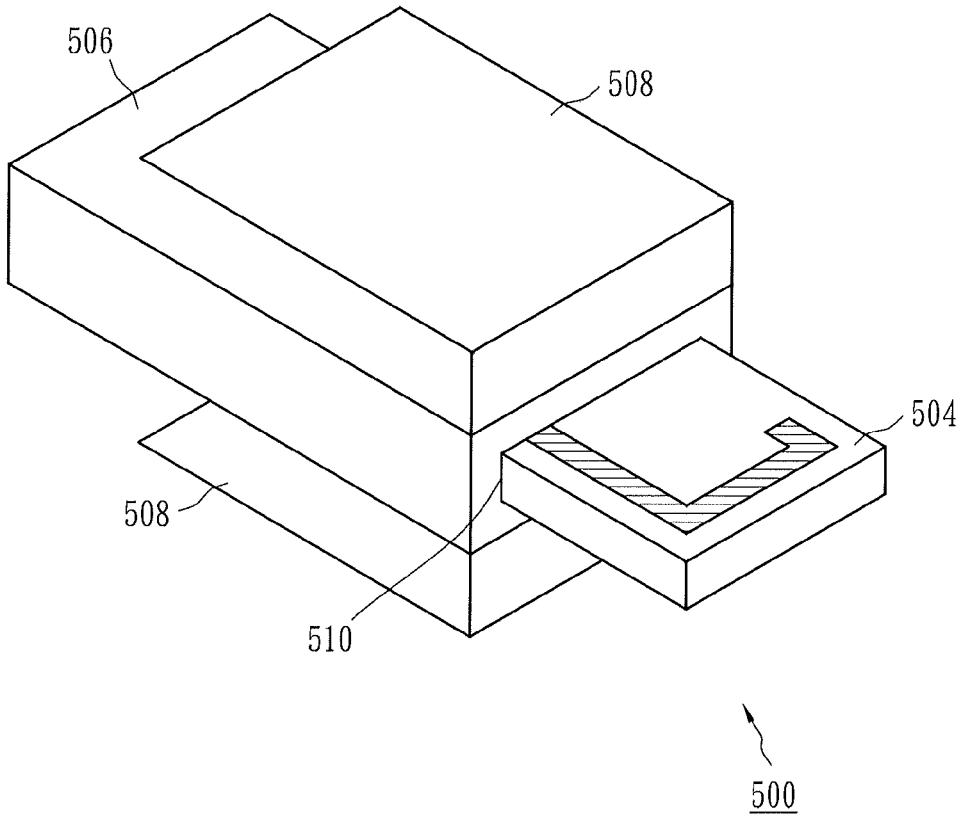
FIG. 6 shows a schematic view of an antenna apparatus according to one embodiment of the present invention.

FIG. 6 shows a schematic view of the antenna apparatus 500 shown in FIG. 5. As shown in FIG. 6, the length of the extending layer 508 equals one quarter of the wavelength of the electromagnetic wave emitted by the antenna apparatus 500. In addition, the end of the extending layer 508 opposing the feed point 510 and the electromagnetic shielding box 506 form an open circuit. Further, the length of the metal antenna also equals one quarter of the wavelength of the electromagnetic wave emitted by the antenna apparatus 500. The antenna end 504 is implemented by printing a metal antenna on an FR-4 board. Since the length of the metal antenna equals one quarter of the wavelength of the electromagnetic wave propagating in the FR-4 board, and the length of the extending layer 508 equals one quarter of the wavelength of the electromagnetic wave propagating in the air, the extending layer 508 is longer than the metal antenna.

Figure 7:
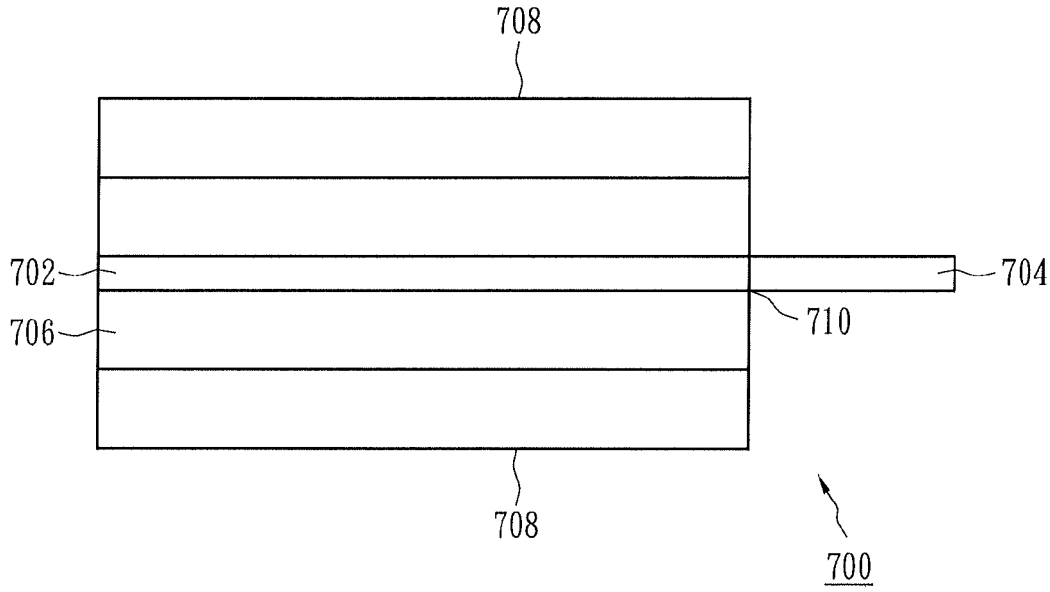
FIG. 7 shows a side view of an antenna apparatus according to another embodiment of the present invention.

FIG. 7 shows a side view of an antenna apparatus according to another embodiment of the present invention. As shown in FIG. 7, the antenna apparatus 700 comprises a printed circuit board 702, an antenna end 704, an electromagnetic shielding box 706 and an extending layer 708. The printed circuit board 702 comprises a radio frequency circuit of the antenna apparatus 700. The antenna end 704 comprises a bent metal antenna, and is connected to the printed circuit board 702. The electromagnetic shielding box 706 covers the printed circuit board 702 to provide noise suppression for the antenna apparatus 700. The extending layer 708 is composed of electrical conducting material, and extends outward from a feed point 710 of the electromagnetic shielding box 706.

Figure 8:
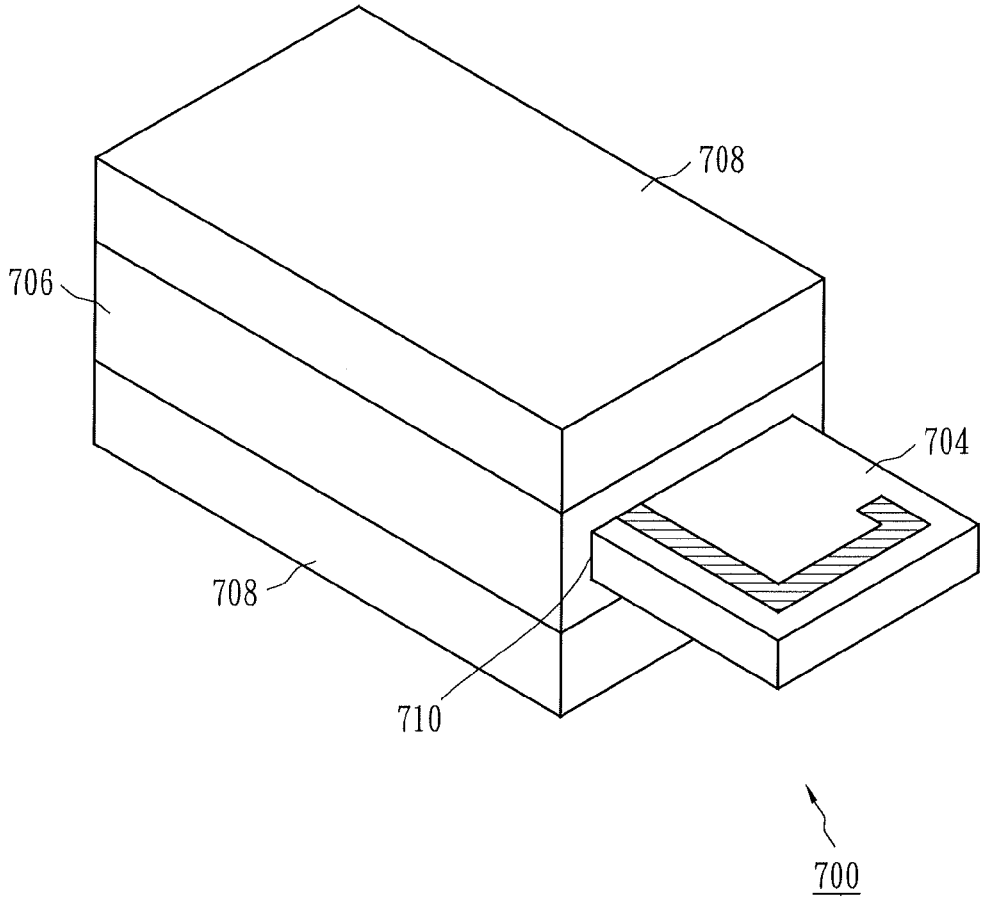
FIG. 8 shows a schematic view of an antenna apparatus according to another embodiment of the present invention.

FIG. 8 shows a schematic view of the antenna apparatus 700 shown in FIG. 7. As shown in FIG. 8, the length of the extending layer 708 equals one half of the wavelength of the electromagnetic wave emitted by the antenna apparatus 700. In addition, the end of the extending layer 708 opposing the feed point 710 and the electromagnetic shielding box 706 form a close circuit. Further, the length of the metal antenna equals one quarter of the wavelength of the electromagnetic wave emitted by the antenna apparatus 700.

Similar to the antenna apparatus 500 shown in FIG. 5, the architecture of the combination of the printed circuit board 702, the antenna end 704 and the electromagnetic shielding box 706 is similar to that of a monopole antenna. In other words, the antenna end 704 serves as a signal source of the antenna apparatus 500. However, the extending layer 708 extending from the feed point 710 of the electromagnetic shielding box 706 serves as a ground of the antenna apparatus 700. That is, the antenna apparatus 700 comprises an antenna end 704 serving as a signal source and an extending layer 708 serving as a ground. Therefore, the antenna apparatus 700 acts as a dipole antenna, and thus it exhibits higher efficiency.

Referring to the embodiments of the present invention shown in FIGS. 6 and 8, two cavities are formed between the extending layer 506 and the electromagnetic shielding box 508, and two cavities are formed between the extending layer 706 and the electromagnetic shielding box 708. That is, a cavity is formed between the extending layer 506 and the top of the electromagnetic shielding box 508; a cavity is formed between the extending layer 506 and the bottom of the electromagnetic shielding box 508; a cavity is formed between the extending layer 706 and the top of the electromagnetic shielding box 708; and a cavity is formed between the extending layer 706 and the bottom of the electromagnetic shielding box 708. In addition, the extending layer 508 extends in the direction parallel to the electromagnetic shielding box 506, and the extending layer 708 also extends in the direction parallel to the electromagnetic shielding box 706. Further, both extending layers 508 and 708 are rectangular from a top view. However, the antenna apparatuses provided by the present invention are not limited to the architectures shown above, but could comprise other architectures without departing from the main concept of the present invention. For instance, in one embodiment of the present invention, the extending layer may cover the electromagnetic shielding box from above such that a cavity is formed between the extending layer and the top of the electromagnetic shielding box. In another embodiment of the present invention, the shape of the extending layer is not limited to rectangular from the top view, but can also be circular or other shapes.

Figure 9:
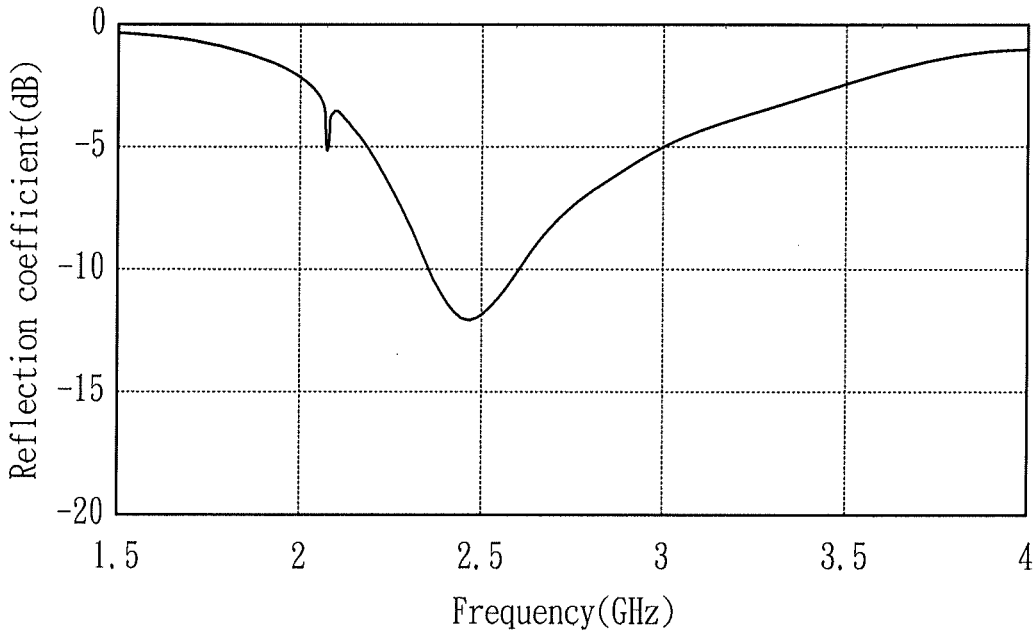
FIG. 9 shows a measured relation between reflection coefficient and frequency of an antenna apparatus according to an embodiment of the present invention.

FIG. 9 shows a measured relation between reflection coefficient and frequency of an antenna apparatus according to an embodiment of the present invention, wherein the antenna apparatus is configured to be operated in the ultra high frequency band. Specifically, the antenna apparatus is used in an IEEE standard 802.11b/g system with reference of −10 dB and low band bandwidth of 243 MHz. As shown in FIG. 9, the antenna apparatus features a better reflection coefficient compared to a conventional monopole antenna.

In conclusion, the antenna apparatus according to the embodiments of the present invention use an extending layer of the low cost electromagnetic shielding box to serve as a ground of the antenna apparatus. Accordingly, the antenna apparatus according to the embodiments of the present invention is similar to a conventional dipole antenna in architecture without having the large size of a conventional dipole antenna. Therefore, the antenna apparatus according to the embodiments of the present invention exhibit both small size and high efficiency, combining advantages of a monopole antenna and a dipole antenna.

The above-described embodiments of the present invention are intended to be illustrative only. Those skilled in the art may devise numerous alternative embodiments without departing from the scope of the following claims.

What is claimed is:

1. An antenna apparatus, comprising:

a planar monopole antenna device including an electromagnetic shielding box; and an extending layer composed of electrical conducting material and extending outward from a feed point of the electromagnetic shielding box, wherein the extending layer covers at least a portion of an outer surface of the electromagnetic shielding box.

2. The antenna apparatus of claim 1, wherein the extending layer extends in a direction parallel to the electromagnetic shielding box.

3. The antenna apparatus of claim 1, wherein a cavity is formed between the extending layer and the electromagnetic shielding box.

4. The antenna apparatus of claim 1, wherein a cavity is formed between the extending layer and the top of the electromagnetic shielding box, and another cavity is formed between the extending layer and the bottom of the electromagnetic shielding box.

5. The antenna apparatus of claim 1, which exhibits characteristics of a dipole antenna such that the extending layer serves as a ground of the dipole antenna.

6. The antenna apparatus of claim 1, wherein the length of the extending layer equals one quarter of the wavelength of the electromagnetic wave emitted by the antenna apparatus, and the end of the extending layer opposing the feed point and the electromagnetic shielding box form an open circuit.

7. The antenna apparatus of claim 1, wherein the length of the extending layer equals one half of the wavelength of the electromagnetic wave emitted by the antenna apparatus, and the end of the extending layer opposing the feed point and the electromagnetic shielding box form a close circuit.

8. The antenna apparatus of claim 1, which is configured to be operated in an ultra high frequency band.

9. An antenna apparatus, comprising:

a printed circuit board comprising a radio frequency circuit;

an antenna end connected to the printed circuit board;

an electromagnetic shielding box covering the printed circuit board; and an extending layer composed of electrical conducting material and extending outward from a feed point of the electromagnetic shielding box, wherein the extending layer covers at least a portion of an outer surface of the electromagnetic shielding box.

10. The antenna apparatus of claim 9, wherein the extending layer extends in a direction parallel to the electromagnetic shielding box.

11. The antenna apparatus of claim 9, wherein a cavity is formed between the extending layer and the electromagnetic shielding, box.

12. The antenna apparatus of claim 9, wherein a cavity is formed between the extending layer and the top of the electromagnetic shielding box, and another cavity is formed between the extending layer and the bottom of the electromagnetic shielding box.

13. The antenna apparatus of claim 9, wherein the extending layer is rectangular from a top view.

14. The antenna apparatus of claim 9, which exhibits characteristics of a dipole antenna such that the extending layer serves as a ground of the dipole antenna, and the antenna end serves as a signal source of a dipole antenna.

15. The antenna apparatus of claim 9, wherein the length of the extending layer equals one quarter of the wavelength of the electromagnetic wave emitted by the antenna apparatus, and the end of the extending layer opposing the feed point and the electromagnetic shielding box form an open circuit.

16. The antenna apparatus of claim 9, wherein the length of the extending layer equals one half of the wavelength of the electromagnetic wave emitted by the antenna apparatus, and the end of the extending layer opposing the feed point and the electromagnetic shielding box form a close circuit.

17. The antenna apparatus of claim 9, wherein the antenna end comprises a bent metal antenna.

18. The antenna apparatus of claim 17, wherein the length of the extending layer is greater than the length of the metal antenna.

19. The antenna apparatus of claim 17, wherein the length of the metal antenna equals one quarter of the wavelength of the electromagnetic wave emitted by the antenna apparatus.

20. The antenna apparatus of claim 9, wherein the antenna end comprises a printed metal antenna on a board.

* * * * *